US006629871B1

(12) United States Patent
Liu

(10) Patent No.: US 6,629,871 B1
(45) Date of Patent: Oct. 7, 2003

(54) TRANSMISSION MECHANISM FOR MOTION TOY

(76) Inventor: Da-Ming Liu, 5F, No. 13, Pao-Kao Road, Hsin Tien City (TW)

( * ) Notice: Subject to any disclaimer, the term of this patent is extended or adjusted under 35 U.S.C. 154(b) by 0 days.

(21) Appl. No.: 10/342,366

(22) Filed: Jan. 15, 2003

(51) Int. Cl.[7] ..... A63H 7/00; A63H 11/00
(52) U.S. Cl. ..... 446/355; 446/353
(58) Field of Search ..... 446/355, 354, 446/353, 357, 377, 376, 330, 331, 358; 40/418, 420, 411, 414, 415; 901/1, 23, 30, 50; 74/45, 48, 49

(56) References Cited

U.S. PATENT DOCUMENTS 4,411,097 A * 10/1983 Murakami ..... 446/376
5,224,896 A * 7/1993 Terzian ..... 446/355
5,628,668 A * 5/1997 Takemae ..... 446/355
6,036,572 A * 3/2000 Sze ..... 446/177
6,322,420 B1 * 11/2001 Daniellian ..... 446/300
6,478,652 B1 * 11/2002 Van der Linde ..... 446/355

* cited by examiner

*Primary Examiner*—Jacob K. Ackun
*Assistant Examiner*—Faye Francis
(74) *Attorney, Agent, or Firm*—Bacon & Thomas, PLLC

(57) ABSTRACT

The present invention is to provide a transmission mechanism for motion toy comprising a transmission box including a transmission gear set having an input meshed with a driven wheel and an output meshed with at least one idler gear; and a leg assembly including at least one pair of legs each having one end pivotably connected to a point in the idler gear distal from its shaft and the other end pivotably connected to one end of a foot. When the driven wheel is driven by a driver element the transmission mechanism can indirectly drive the idler gear and shift the leg horizontally. In such a manner, a motion toy having a plurality of the transmission mechanisms can walk step by step on a planar surface.

9 Claims, 6 Drawing Sheets

TRANSMISSION MECHANISM FOR MOTION TOY

FIELD OF THE INVENTION

The present invention relates to motion toys and more particularly to a transmission mechanism for motion toy with improved characteristics.

BACKGROUND OF THE INVENTION

A variety of toys (e.g., toy dogs, toy cats, toy cartoons, and so on) were dull, motionless (i.e., no moving, vibrating, or stepping motion) several decades ago. Nowadays, many motion toys are available to consumers due to the progress of technology and increasing demand. Conventionally, these motion toys are capable of moving, vibrating, rotating, and/or jumping. They are much attractive to the consumers as compared to the motionless toys.

A typical motion toy is shown in FIGS. 1 and 2. In its lower portion, there is comprised of a transmission box 2 and two legs 4 in cooperation with the transmission box 2. In the transmission box 2, there are provided a driver (not shown) and a transmission shaft 20 coupled to and driven by the driver. Two ends of the transmission shaft 20 are projected from the transmission box 2. A cam 3 is provided at either end of the transmission shaft 20. The cam 3 comprises a first connection member 30 proximate the transmission box 2 and coupled to the transmission shaft 20 so that the cam 3 can be rotated eccentrically. The cam 3 further comprises a second connection member 32 distal from the transmission box 2 at the same side as the leg 4. The first and second connection members 30, 32 are at different sides of the cam 3 and are not aligned each other. The second connection member 32 is coupled to a link 40 in the leg 4. As such, a rotation of the cam 3 may cause the legs 4 to move accordingly by a link mechanism formed of the second connection members 32 and the links 40.

However, the prior art motion toy suffered from several disadvantages in despite of being movable. For example, its components are complicated and the number thereof is excessive due to many link mechanisms. Hence, a malfunctioned component may hinder or even prohibit a normal action thereof. This can cause troubles to the user. Moreover, a manufacturing cost will be increased significantly. Further, design of the link mechanisms is complicated and difficult. Furthermore, movable components may be impeded one another in operation, resulting in an awkward, non-smooth motion. As an end, a purpose of providing an animated, lovely, and ergonomic motion toy is not achieved.

In view of the above disadvantages of the well-known motion toy and for conforming to the modern management concepts of high quality while low cost, further improvements still exist. As such, it is desirable for the toy manufacturers to provide a variety of animated, real, lovely, and ergonomic motion toys to the consumers.

SUMMARY OF THE INVENTION

The present invention is directed to provide a transmission mechanism for a motion toy. The present invention is capable of overcoming the above drawbacks of the prior art such as dull, motionless toys available several decades ago and complicated and excessive components and awkward, non-smooth motion of modern motion toys.

A primary object of the present invention is to provide a transmission mechanism for motion toy comprising a transmission box including a transmission gear set having an input meshed with a driven wheel and an output meshed with at least one idler gear; and a leg assembly including at least one pair of legs each including: a horizontal movement section at its portion adjacent the idler gear, the horizontal movement section having a longitudinal slot in its central part, the other end of the horizontal movement section being bent to pivotably connect to one end of either foot; and a vertical movement section slidable along and defined in the longitudinal slot, the vertical movement section having one end pivotably connected to a point in the idler gear distal from its shaft and the other end pivotably connected to the other end of either foot. When the driven wheel is driven by a driver element the transmission mechanism can indirectly drive the idler gear by means of the transmission gear set. As such, the idler gear may rotate in the same rotational direction. The horizontal movement section is then shifted horizontally. In such a manner, a motion toy having a plurality of the transmission mechanisms can walk step by step on a planar surface. The transmission mechanism is advantageous for having fewer components, a lower manufacturing cost, and being capable of imitating a walking of human being or animal as mounted in the motion toy.

The above and other objects, features and advantages of the present invention will become apparent from the following detailed description taken with the accompanying drawings.

DETAILED DESCRIPTION OF THE PREFERRED EMBODIMENTS

Figure 1:
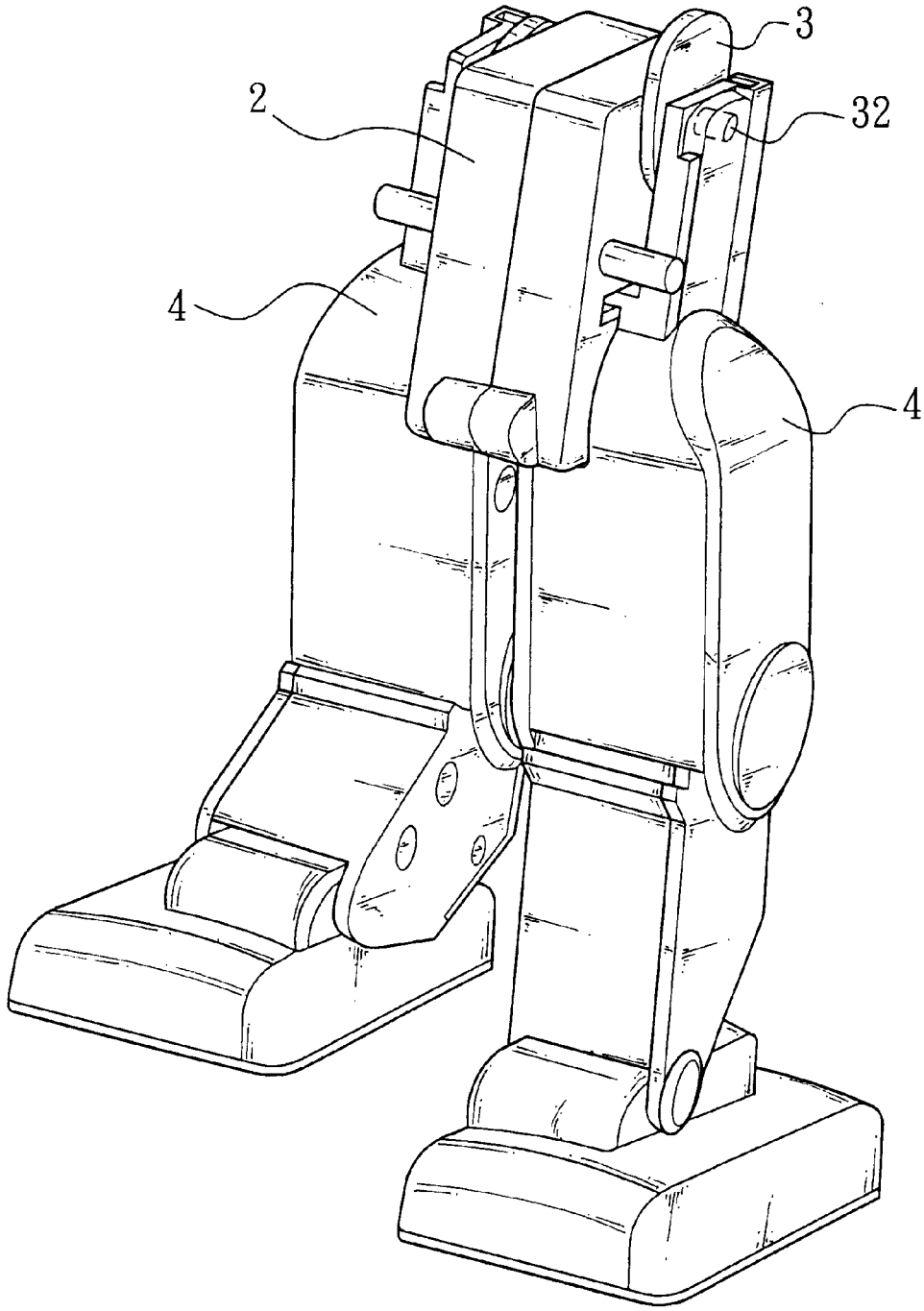
FIG. 1 (Prior Art)
FIG. 1 is a perspective view of transmission mechanism of a conventional motion toy.
Figure 2:
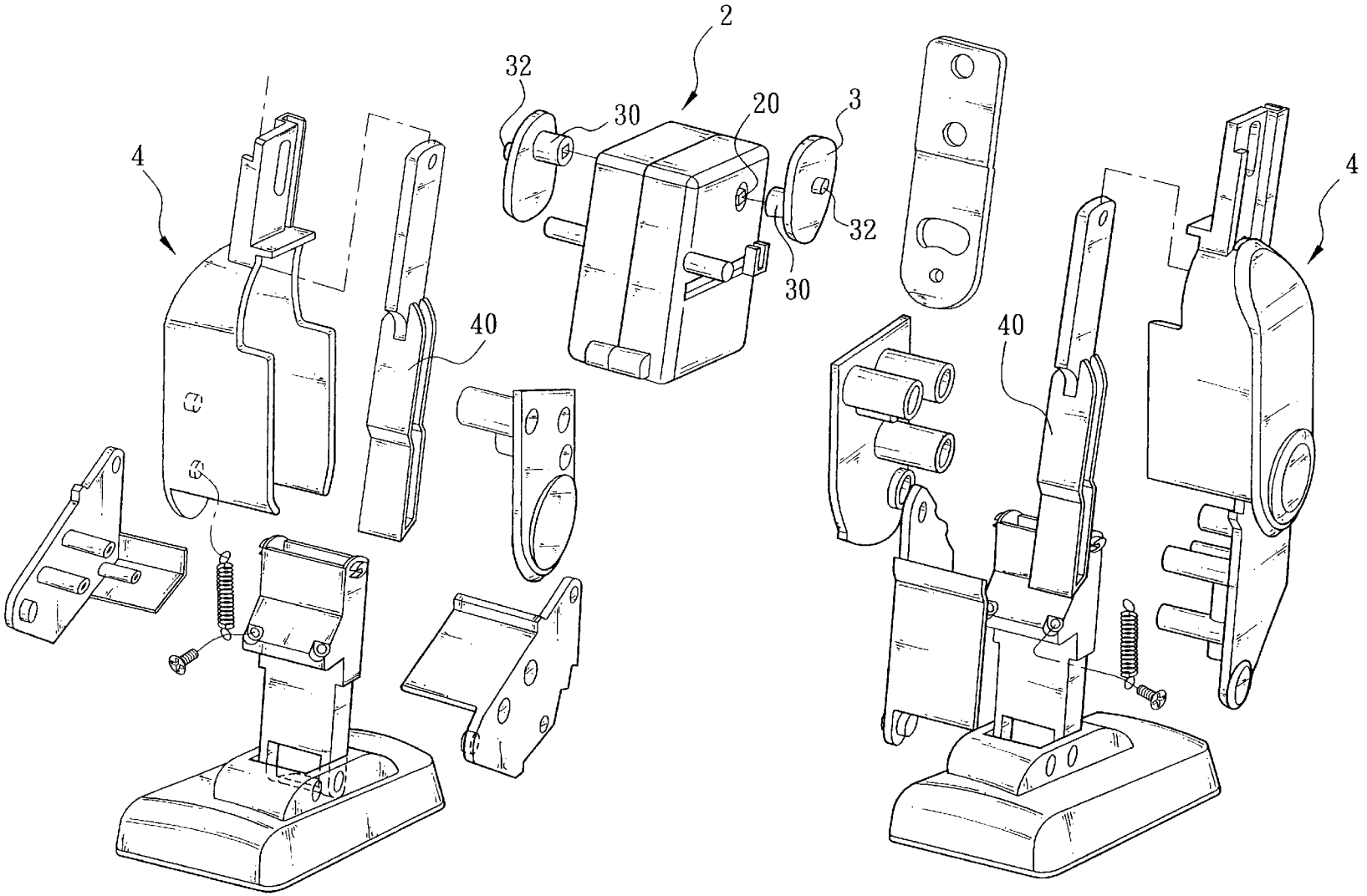
FIG. 2 (Prior Art)
FIG. 2 is an exploded view of FIG. 1.
Figure 3:
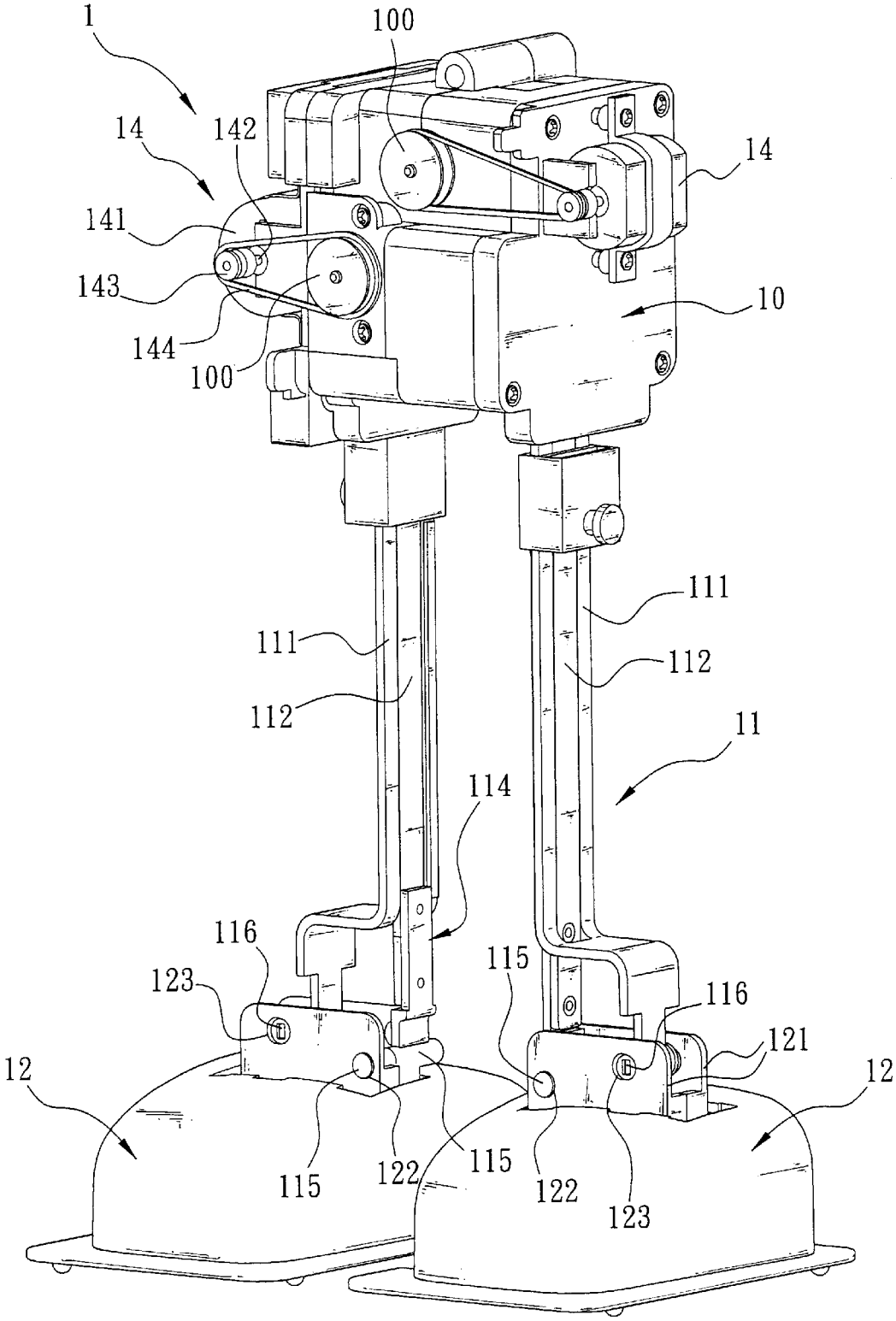
FIG. 3 is a perspective view of a preferred embodiment of transmission mechanism mounted in a motion toy according to the invention.
Figure 4:
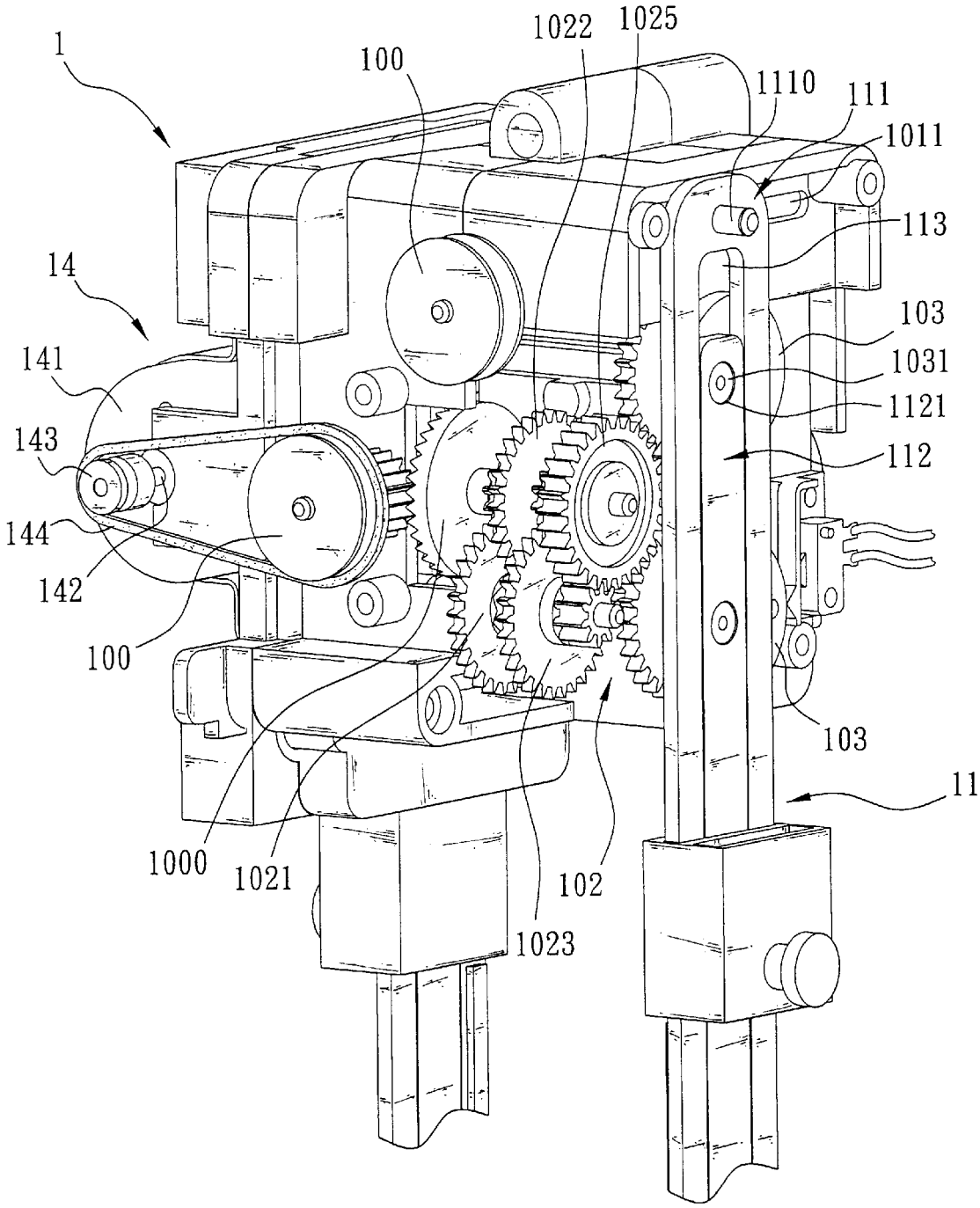
FIG. 4 is a perspective view of upper portion of FIG. 3 with cover of transmission box removed to show interior details thereof.
Figure 5:
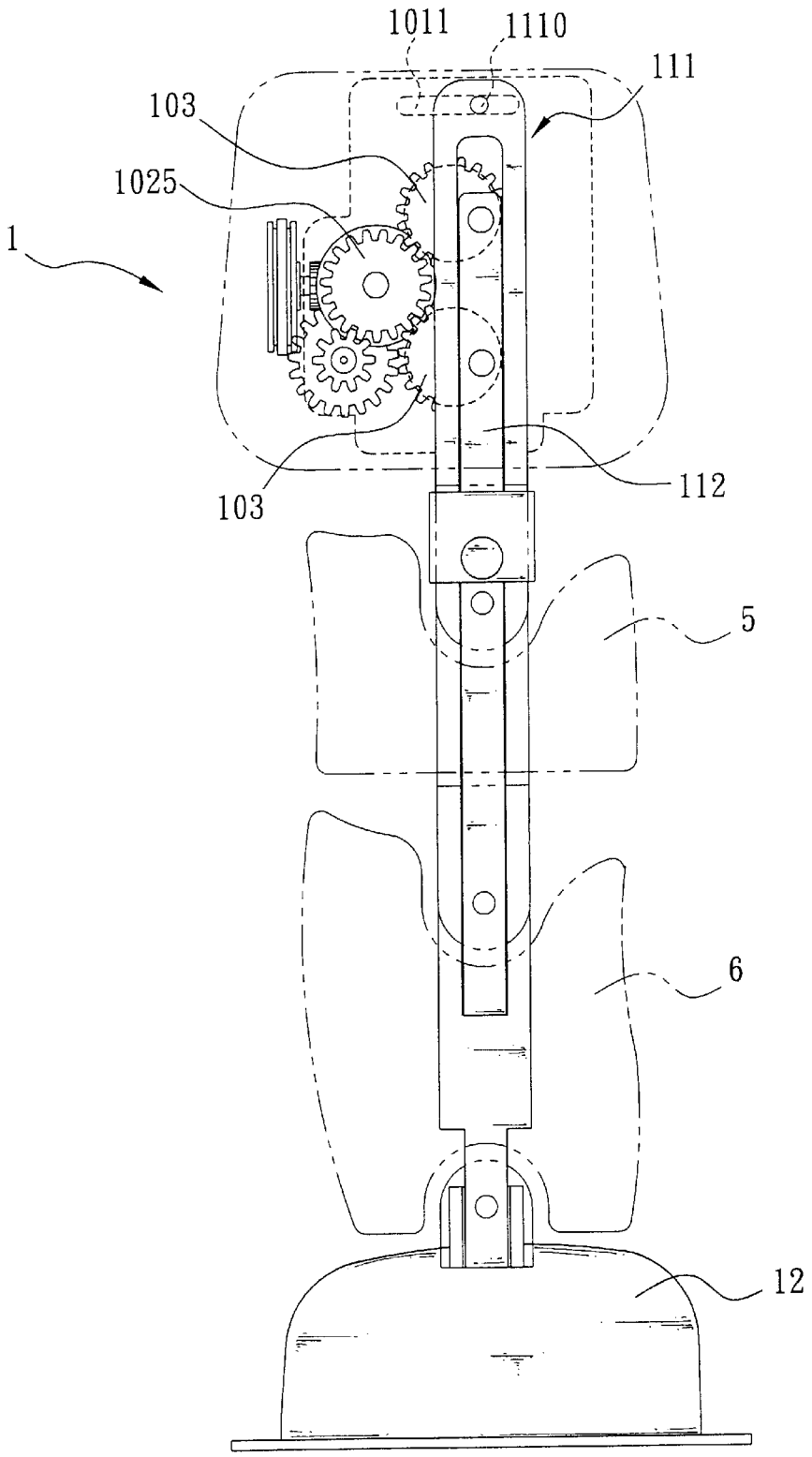
FIGS. 5 and 6 are side views schematically showing operations of the transmission mechanism.
Figure 6:
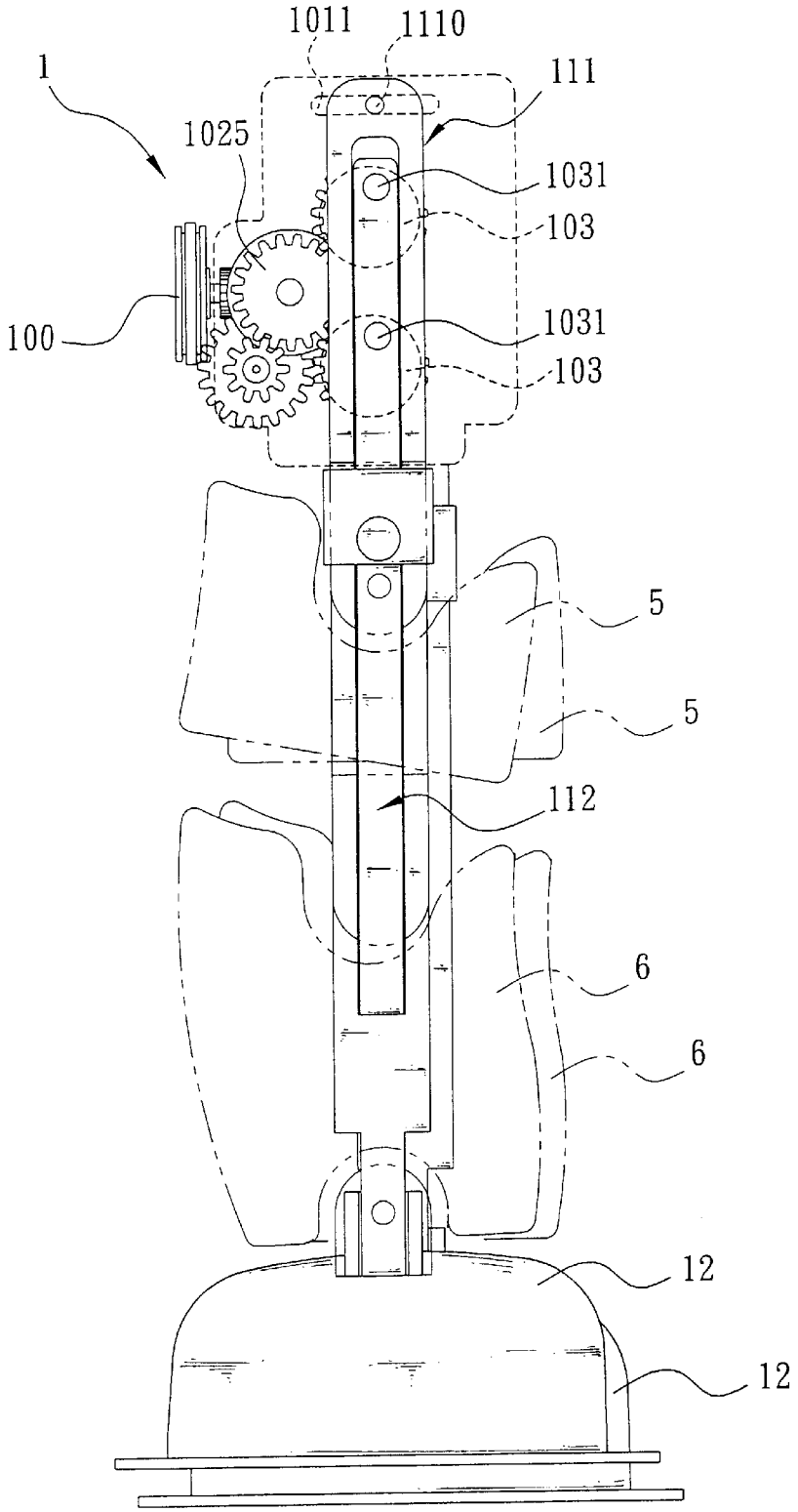

Referring to FIGS. 3 and 4, there is shown a transmission mechanism 1 for motion toy in accordance with the invention comprising a transmission box 10 including an internal transmission gear set 102 having an input meshed with a gear member of a driven wheel 100 and an output meshed with at least one idler gear (two are shown) 103. The transmission mechanism 1 further comprises two legs 11 having their upper portions adjacent the idler gears 103. The leg 11 comprises a horizontal movement section 111 and a vertical movement section 112. A longitudinal slot 113 is formed in the central part of the horizontal movement section 111. A lower portion at the other end of the horizontal movement section 111 is bent to pivotably connect to one end of one of the feet 12. The vertical movement section 112 is slidable along and defined in the slot 113. The vertical movement section 112 has one end pivotably connected to a point in the idler gear 103 distal from its shaft and the other end pivotably connected to the other end of the foot 12. Referring to FIGS. 4 and 5, when the driven wheel 100 is driven by a driver element 14 the transmission mechanism 1 can indirectly drive the idler gear 103 by means of the transmission gear set 102. As such, the idler gear 103 may rotate in the same rotational direction. Referring to FIGS. 4 and 6, the horizontal movement section 111 is then shifted horizontally. In such a manner, a motion toy having a plurality of transmission mechanisms 1 can walk step by step on a planar surface.

Referring to FIGS. 3, 4, 5, and 6, the number and locations of the transmission mechanisms 1 may be varied in applications. For example, two transmission mechanisms 1 can be mounted in the motion toy which is implemented as a robot. As such, an alternate forward movement of left and right legs of the robot can be controlled by the transmission mechanisms 1. This is an imitation of human being's walking. In another example, four transmission mechanisms 1 can be mounted in the motion toy which is implemented as a toy dog. As such, an imitation of four-leg movement of a real dog can be effected. However, techniques regarding how to control an alternate power output of all driver elements 14 for rendering a smooth, well-coordinated back and forth or left and right movement of the motion toy on the surface are well-known. Further, they are not critical to the invention. Thus a detailed description thereof is omitted herein for the sake of brevity.

Referring to FIGS. 3, 4, 5, and 6, in the invention as stated above, the other ends of both the horizontal movement section 111 and the vertical movement section 112 are coupled to the foot 12. When the vertical movement section 112 moves up and down with respect to the ground one end of the foot 12 moves accordingly. Two parallel plates 121 are projected above the foot 12 (see FIG. 3). Each plate 121 has a first hole 122 and a spaced second hole 123. The vertical movement section 112 is coupled to one end of a connection member 114. A first pin 115 is formed in opposite sides at the other end of the connection member 114. The first pin 115 is further pivotal about the first hole 122. Similarly, a second pin 116 is formed in opposite sides at the other end of the horizontal movement section 111. The second pin 116 is further pivotal about the second hole 123. With such configuration, a mechanism similar to human being's ankle is formed between the vertical movement section 112 and the foot 12. As a result, the motion toy of the invention can show a balanced, smooth movement while walking forward.

Referring to FIGS. 3 and 4, the driver element 14 (e.g., direct current (DC) motor) has a housing 141 and a shaft 142 projected from one side of the housing 141. A drive wheel 143 is fixed at one end of the shaft 142 distal from the housing 141. A belt 144 is put around the spaced drive wheel 143 and the driven wheel 100 to form a chain wheel. As a result, power from the drive wheel 143 can be transmitted to the transmission gear set 102 for moving the legs 11 by rotating the driven wheel 100 through the conveying belt 144.

Referring to FIGS. 3 and 4, in the invention the transmission gear set 102 is mounted in the transmission box 10 and is comprised of a bevel gear 1000 and a plurality of transmission gears. One side of the bevel gear 1000 is meshed with the driven wheel 100 while the other side thereof is meshed with one side of a first transmission gear 1021. The other side of the first transmission gear 1021 is meshed with one side of a second transmission gear 1022. Similarly, the other side of the second transmission gear 1022 is meshed with one side of a third transmission gear 1023. The meshing process continues until a N-th (N is an integer limited by the size of the transmission box 10 and as required) transmission gear 1025 is meshed together. The driven wheel 100 is projected from the transmission box 10. The N-th transmission gear 1025 is meshed with both the idler gears 103 at the same time. As a result, a rotation of the N-th transmission gear 1025 causes the driver element 14 to rotate in synchronism in the same rotational direction.

Referring to FIGS. 3, 4, 5, and 6, in the invention the horizontal movement section 111 comprises a guide bar 1110 distal from the foot 12. An elongate slot 1011 perpendicular to the horizontal movement section 11 is formed on the transmission box 10. The guide bar 1110 is slid along and defined by the slot 1011 as the horizontal movement section 111 slides. In addition, as stated above, the vertical movement section 112 is slidable in the slot 113. One end of the vertical movement section 112 is pivotably connected to a point in the idler gear 103 distal from its shaft. Two pegs 1031 are projected from the idler gears 103 adjacent the vertical movement section 112. Two apertures 1121 are formed at the vertical movement section 112. The pegs 1031 are inserted into and pivotal about the apertures 1121. With such configuration, a synchronous rotation of the idler gears 103 causes the vertical movement section 112 to shift a predetermined distance in the slot 113.

Referring to FIGS. 3, 5, and 6, portion of the leg 11 adjacent the transmission box 10 is pivotably coupled to a thigh housing 5. A calf housing 6 is pivotably connected between the thigh housing 5 and the foot 12. With such configuration, the thigh and calf housings 5, 6 move as the motion toy of the invention lifts its feet for walking. This is similar to a bending of human being's knee while walking.

While the invention has been described by means of specific embodiments, numerous modifications and variations could be made thereto by those skilled in the art without departing from the scope and spirit of the invention set forth in the claims.

What is claimed is:

1. A transmission mechanism for a motion toy comprising:

a transmission box including a transmission gear set having an input meshed with a driven wheel driven by a driver element and an output meshed with at least one idler gear; and a leg assembly including at least one pair of legs each including:

a horizontal movement section at its portion adjacent the idler gear, the horizontal movement section having a longitudinal slot in its central part, the other end of the horizontal movement section being bent to pivotably connect to one end of the foot; and a vertical movement section slidable along and defined in the longitudinal slot, the vertical movement section having one end pivotably connected to a point in the idler gear distal from its shaft and the other end pivotably connected to the other end of the foot.

2. The transmission mechanism of claim 1, wherein each foot comprises two parallel plates projected upward, each having a first hole and a spaced second hole and either leg comprises a connection member having one end coupled to the vertical movement section, a first pin in opposite sides at the other end of the connection member, the first pin being pivotal about the first hole, and a second pin in opposite sides at the other end of the horizontal movement section, the second pin being pivotal about the second hole.

3. The transmission mechanism of claim 1, the driver element is a direct current (DC) motor.

4. The transmission mechanism of claim 3, wherein the DC motor comprises a housing, a shaft projected from one side of the housing, and a drive wheel fixed at one end of the shaft distal from the housing.

5. The transmission mechanism of claim 4, wherein the driver element further comprises a belt put around the spaced drive wheel and the driven wheel to form a chain wheel.

6. The transmission mechanism of claim 5, wherein the driven wheel is projected from the transmission box and the transmission gear set is mounted in the transmission box and comprises a bevel gear having one side meshed with the driven wheel and a plurality of transmission gears meshed one another.

7. The transmission mechanism of claim 1, wherein the horizontal movement section further comprises a guide bar distal from the foot, further comprising an elongate slot on the transmission box perpendicular to the horizontal movement section wherein the guide bar is slidable along and defined by the elongate slot as the horizontal movement section slides.

8. The transmission mechanism of claim 1, further comprising two pegs projected from the idler gear adjacent the vertical movement section and two apertures at the vertical movement section wherein the pegs are inserted into and pivotal about the apertures.

9. The transmission mechanism of claim 1, wherein each leg comprises a pivotal thigh housing adjacent the transmission box and a calf housing pivotably connected between the thigh housing and the foot.

* * * * *